United States Patent [19]

Nakayama et al.

[11] 4,216,250

[45] Aug. 5, 1980

[54] METHOD FOR PRODUCING A STEEL SHEET HAVING A ZINC COATING ON ONE SIDE

[75] Inventors: Motohiro Nakayama, Aichi; Kazutsugu Nakajima, Tokai, both of Japan

[73] Assignee: Nippon Steel Corporation, Tokyo, Japan

[21] Appl. No.: 797,737

[22] Filed: May 17, 1977

[30] Foreign Application Priority Data

| | | | |
|---|---|---|---|
| May 19, 1976 | [JP] | Japan | 51-57611 |
| Nov. 12, 1976 | [JP] | Japan | 51-136075 |
| Mar. 23, 1977 | [JP] | Japan | 52-31725 |

[51] Int. Cl.[2] ..... B05D 3/12

[52] U.S. Cl. ..... 427/289; 427/360; 427/367; 427/383.9; 427/433; 427/376.7; 427/376.8

[58] Field of Search ..... 51/323; 204/36, 37 R; 427/289, 360, 367, 383 D, 376 G, 376 H, 433

[56] References Cited

U.S. PATENT DOCUMENTS

| | | | |
|---|---|---|---|
| 1,307,853 | 6/1919 | Dimm | 204/37 R |
| 2,158,063 | 5/1939 | Broadfield | 51/323 X |
| 4,015,950 | 4/1977 | Galland et al. | 428/648 |
| 4,059,711 | 11/1977 | Mino et al. | 427/360 X |
| 4,120,997 | 10/1978 | Franks et al. | 427/367 |

*Primary Examiner*—Evan K. Lawrence

*Attorney, Agent, or Firm*—Toren, McGeady and Stanger

[57] ABSTRACT

A method for producing a one-side zinc plated steel sheet, comprising;

(a) a step of coating a steel sheet with zinc, (b) a step of heating the zinc-coated steel sheet to alloy at least the coated zinc on one side of the steel sheet with the steel sheet, and (c) a step of mechanically removing the coated zinc thus alloyed.

10 Claims, 7 Drawing Figures

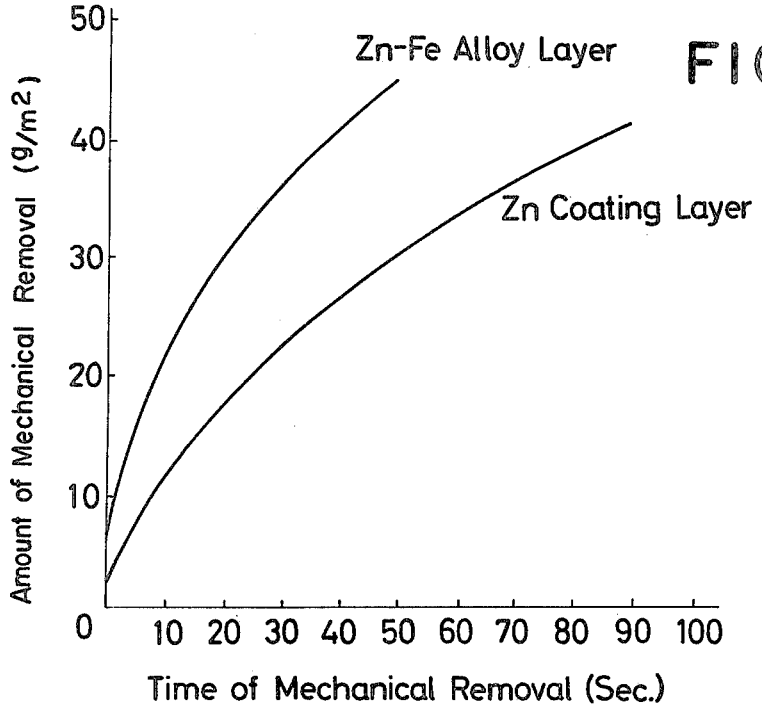
FIG.1
FIG.2
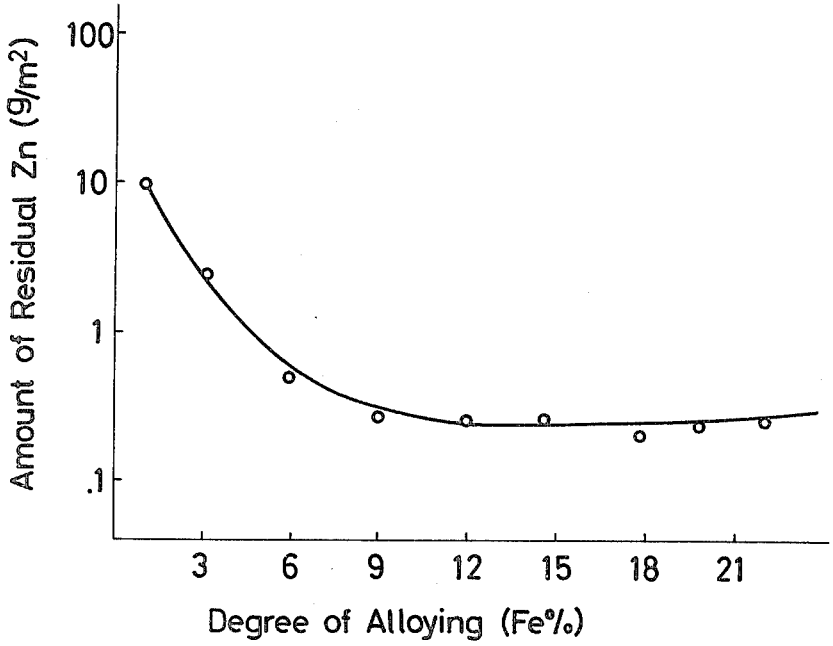

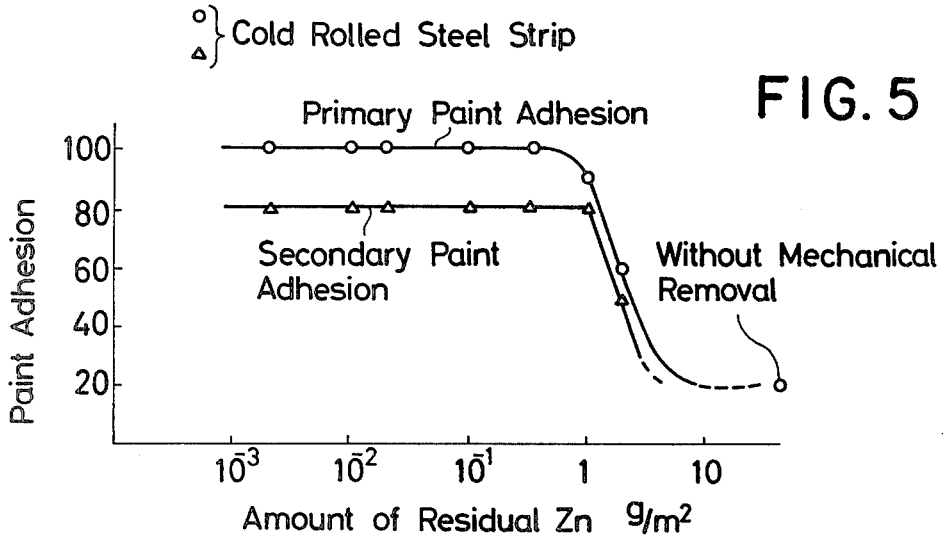
FIG. 5
FIG.7
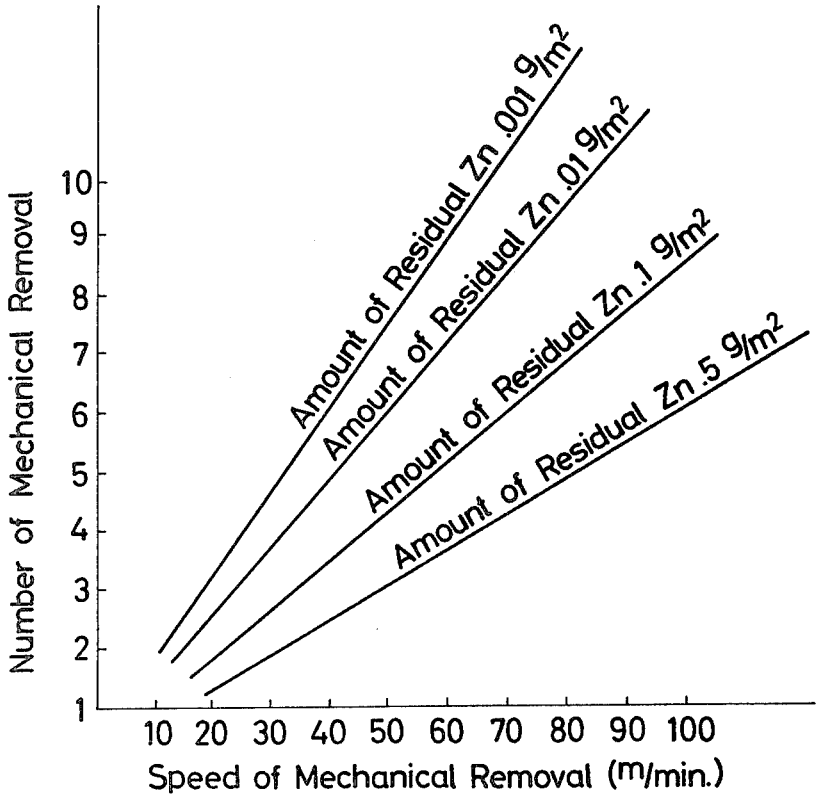

METHOD FOR PRODUCING A STEEL SHEET HAVING A ZINC COATING ON ONE SIDE

BACKGROUND OF THE INVENTION

1. Field of the Invention

The present invention relates to a method for producing a steel sheet or strip (hereinafter called simply steel sheet) having a zinc or zinc alloy coating on one side. The present invention is particularly advantageous for producing a one-side zinc or zinc alloy coated steel sheet, but the present invention is also applicable to production of one-side Al, Al-Fe or Al-Zn alloy coated steel sheet.

2. Description of the Prior Art

It is conventionally well known to apply a plating prevention agent or film such as water glass (Japanese Patent Publication No. Sho 39-4522) or a phosphate film (Japanese Patent Publication No. Sho 42-24960) on one side of the steel sheet, and introduce the steel sheet thus applied with the plating prevention agent or film on one side into a metal-plating bath so as to obtain a steel sheet having a metal coating only on one side.

However, these conventional methods have such technical and economical defects that a stable one-side metal coating can not be obtained because it is difficult to satisfactorily prevent the metal plating with the plating prevention agent or film. As a result, coated steel product is very low in its commercial value and quality, and that it requires an additional step for removing the plating prevention agent or film applied on the steel sheet.

SUMMARY OF THE INVENTION

Therefore, one of the objects of the present invention is to overcome the various defects confronted with by the conventional arts.

The gist of the present invention lies in that a steel sheet or strip is subjected to metal-plating such as zinc-plating and then the base metal is made to alloy with the coated metal on one side of the steel sheet or strip by heating so as to form a brittle alloy layer such as Fe-Zn and Fe-Al layer, and the metal coating on one side of the steel sheet or strip is removed mechanically by such as grinding, horning, scrapping, brushing, etc. to obtain a steel sheet or strip having a metal coating only on its one side.

According to another feature of the present invention, the steel sheet or strip after the removal of the metal coating from its one side is, in case of necessity, subjected to a temper rolling to flatten the side from which the metal coating has been mechanically removed so as to obtain, for example, a beautiful final finish after paint coating with enhanced product value.

Further, according to a modification of the present invention, in case of Zn-Fe alloy coating for example the surface roughness after the mechanical removal of the metal coating is maintained at a value not larger than 10$\mu$, and 1 g/m$^2$ to 0.001 g/m$^2$ of the coated metal, more specifically zinc is retained on the surface from which the coated metal is mechanically removed (hereinafter called mechanically removed surface).

DETAILED DESCRIPTION OF THE INVENTION

The present invention will be described in more details referring to the attached drawings.

BRIEF DESCRIPTION OF THE DRAWINGS

FIG. 1 is a graph showing difference in the mechanical removability of the coated metal between a zinc-plated steel sheet which has been subjected to the alloying treatment according to the present invention and a zinc-plated steel sheet which has not been subjected to the alloying treatment.

FIG. 2 is a graph showing the relation between the alloying degree and the mechanical removability of the coated metal.

FIG. 5 is a graph showing the amount of zinc remaining on the mechanically removed surface and the paint adhesion.

FIG. 7 is a graph showing the relation between the number and speed of the mechanical removal and the amount of the remaining zinc.

Figure 3:
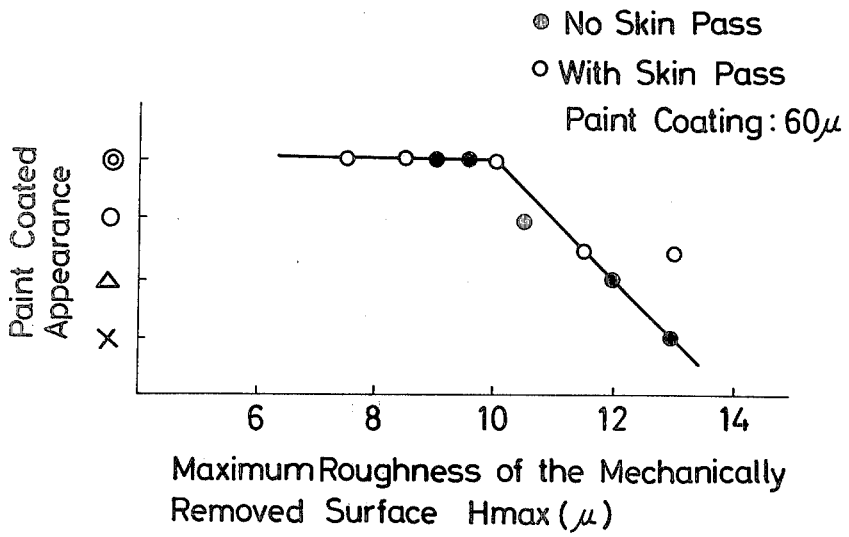
FIG. 3 is a graph showing the relation between the paint coated appearance (60$\mu$ paint coating) and the maximum roughness (H max) of the mechanically removed surface.

The present inventors have made extensive studies on the removal of the coated metal from one side of a steel sheet, and it has been discovered that the coated metal can be very easily removed mechanically, if the coated metal and the base metal are alloyed by heating before the mechanical removal as shown in FIG. 1. Preferably, the alloy layer thus formed by the heating contains 6 to 20% by weight of iron, in case of Zn-Fe alloy coating.

By this alloying treatment, a very brittle iron alloy, such as Fe-Zn and Fe-Al is formed, which makes it easy to mechanically remove the coated metal by such as grinding, horning, scrapping, brushing, etc.

Meanwhile, it is preferable to minimize the amount of the metal being coated on one side of the steel sheet in the metal plating step so as to minimize and facilitate the mechanical removal thereof after the alloying treatment. This minimization is desirable also from the point of the production cost.

As for the alloying treatment, the metal-plated steel sheet taken from a conventional plating bath and having a controlled amount of the coated metal may be subjected to heating such as gas flame heating, electrical heating, so as to obtain the desired alloy layer.

The alloying treatment will be described in more details in connection with a zinc-plated steel sheet.

The heating must be enough to alloy the coated zinc with the base metal.

In order to facilitate the mechanical removal of the coated metal layer, it is necessary to form an alloy layer composed of at least one of $\zeta$, $\oplus_1$, $\Gamma$ iron-zinc alloys, and for this purpose, the iron content in the formed alloy layer should be controlled in a range from 6 to 20%. With iron contents less than 6%, the mechanical removal is not satisfactory as shown in FIG. 2. More particularly, with iron contents less than 6%, the alloying is not attained up to the surface of the coated metal layer or alloyed portions and non-alloyed portions mingle together so that it is difficult to obtain a uniformly alloyed layer. In such cases, a zinc layer ($\eta$ phase) remains on the surface of the metal coated layer which causes difficulties in the mechanical removal of the coated metal. For example, the zinc layer ($\eta$ phase), when mechanically ground, expands on the surface or the grinding powders adhere to the surface, thus causing the difficulties.

On the other hand, the iron-zinc alloy of $\zeta$ phase, $\delta_1$ phase or $\Gamma$ phase is hard and brittle, easy to mechanically removed, and the grinding powders do not adhere to the surface or to the grinding tools.

Particularly in case of the mechanical removal of the coated metal by means of a beltsander, the removability is remarkably lowered, if the zinc layer ($\eta$ phase) is present because it fills up the belt, so that the service life of the belt is very short and it is difficult to obtain a desired amount of zinc remaining on the mechanically removed surface.

On the other hand, it is possible to obtain a satisfactory mechanical removability of the coated metal with iron contents less than 20%, and an excessive alloying beyond 20% of iron content causes an excessive alloying of the coated metal on the other side of the steel sheet and lowers the metal coating adhesion.

In order to obtain the alloyed layer within the above range of the iron content, the necessary alloying may be performed in an alloying furnace at a temperature from 500° to 1000° C. for 5 to 50 seconds when the coated steel sheet is subjected to the alloying treatment immediately after the metal-plating.

Further, according to the present invention, both sides of the metal coated steel sheet may be subjected to the alloying treatment, and the coated metal on one side is mechanically removed while the coated metal on the other side is retained as an alloyed metal coating, so as to obtain a steel sheet having an alloyed metal coating only on its one side.

As mentioned hereinbefore, the present invention has an additional feature in that the steel sheet having a metal coating only on its one side produced by the mechanical removal the metal coated on the other side is subjected to flattening treatment such as by temper rolling to flatten the mechanically removed surface at least so as to assure a beautiful appearance after paint coating and an enhanced commercial value.

According to the present invention, the various difficulties confronted with by the prior arts have been completely overcome by the mechanical removal of the metal coated on one side of the metal-plated steel sheet without lowering the efficiency of the plating line, thus maintaining a high degree of productivity.

However, in some cases the mechanically removed surface is damaged by the mechanical removing operation, such as grinding, and this damage often causes a defect that the surface irregularities caused by the mechanical removing operation appear even after the paint coating, and thus becomes vital defects in some applications. Therefore, for such applications, it is necessary to flatten the mechanically removed surface by such as temper rolling to eliminate the surface unflatness.

Thus, according to the present invention, when the coated metal is mechanically removed by a beltsander, the coated metal can be removed satisfactorily by a rotation speed (circumferential speed) ranging from 800 to 2500 m/minutes with a belt surface roughness of 150 or higher, a pressing power ranging from 0.2 to 2.0 kw/m in case of a zinc-plated steel sheet with not larger than about 150 g/m$^2$ of zinc coating, running at a speed at 200 m/minute or less.

When the coated metal has been mechanically removed as above, the temper rolling may be done with a reduction ranging from 0.2 to 5.0% to completely eliminate the surface unflatness caused by the mechanical removing operation. More specifically, with a temper rolling roll having 2.3 to 3.6$\mu$-r.m.s. roughness, the surface damages can be satisfactorily eliminated by a reduction ranging from 0.2 to 3.0%, and with a roll surface roughness ranging from 1.6 to 2.0 $\mu$-r.m.s., a reduction ranging from 0.2 to 5.0% is enough.

The unit "$\mu$-r.m.s." is an expression in $\mu$ unit of a value by root mean square of the roughness curve measured by a contact needle with a top end radical of 5$\mu$. (See JIS B-0655)

With the above treatments, it is possible to obtain a steel sheet having a metal coating only on its one side with excellent surface properties.

As mentioned hereinbefore, the present invention is applicable to production of a one-side Al, Al-Fe alloy, or Al-Zn alloy coated steel sheet by a similar process (plating-alloying-mechanical removal) as in case of the one-side Zn or Zn-Fe alloy coated steel sheet.

Further, the present inventors have found through various extensive studies that when the metal coating on the steel sheet is mechanically removed so as to obtain an activated metal surface with a surface maximum roughness not larger than 10$\mu$ and 1 g/m$^2$ to 0.001 g/m$^2$ of zinc retaining thereon, it is possible to assure a uniform, beautiful surface appearance, excellent paint adhesion and excellent corrosion resistance after paint coating. It has been also discovered that the one-side plated steel sheet thus obtained is very useful for automobile skins.

Conventionally cold rolled steel sheets are predominantly used for the automobile steel sheet, and the outer side of the sheets is painted with a coating thickness ranging from 60 to 100$\mu$ while the back side is coated with only 10 to 15$\mu$ electro-deposited paint film or left uncoated. Therefore, problems such that the back side of the steel sheet used as the automobile skin is easily attacked by water predominating thereinto or salt sprayed on the roads for prevention of the road freezing have been arisen, and for solution of these problems, use of zinc-plated steel sheets has been proposed in recent years.

However, the zinc-coated steel sheet used as the automobile skin has a defect that it lacks surface uniformity, resulting in unsatisfactory surface appearance after paint coating and poor paint adhesion. The one-side plated steel sheet according to the present invention is very useful for overcoming the above defect.

Therefore, another aspect of the present invention lies in that the mechanically removed surface of the one-side plated steel sheet is activated to have a maximum roughness of not larger than 10$\mu$ and to retain 1 g/m$^2$ to 0.001 g/m$^2$ of zinc thereon.

The term "maximum roughness" used herein is the sum of the average height of the highest 10 summits and the average depth of 10 deepest bottoms in ½ inch scanning distance in the roughness curve measured by a contact needle having a top end radial of 5$\mu$. The term "maximum roughness" is expressed herein in "H max". (See JIS B-0601)

When the maximum roughness of the mechanically removed surface is maintained at 10$\mu$ or less, the scratch stripes caused by the grinding during the mechanical removal of the coated metal does not damage the paint coated appearance in case of a paint coating thickness of 60$\mu$ or thicker as usually applied as shown in FIG. 3.

The estimation standards of the paint coated appearance in FIG. 3 are as below.

◎: there is no scratch-stripe appearance

O: there is a very slight scratch-stripe observablly by naked eyes.

Δ: there is a slight scratch-stripe observable by naked eyes.

X: there is a distinct scratch-stripe.

The mechanical removal of the coated metal according to the present invention can also eliminate spangle patterns on the zinc-coated surface to develop a uniform and beautiful surface profile.

Figure 4:
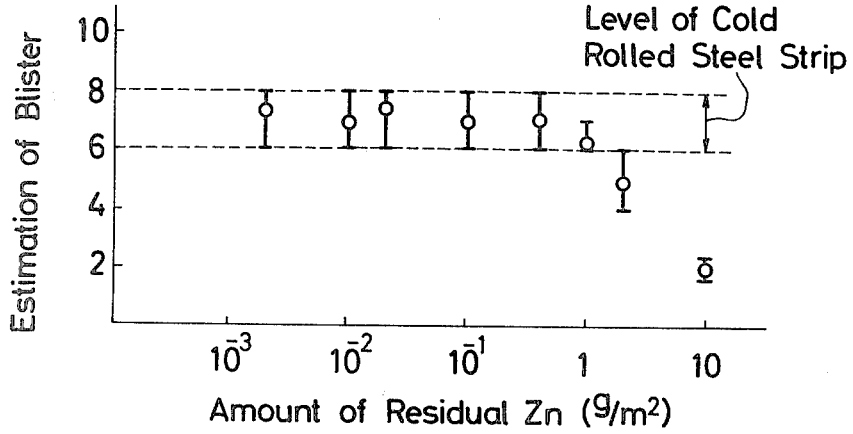
FIG. 4 is a graph showing the relation between the amount of zinc remaining on the mechanically removed surface, and the corrosion resistance after the paint coating.

Regarding the amount of zinc remaining on the mechanically removed surface, it is preferable the amount ranges from 1 g/m$^2$ to 0.001 g/m$^2$ as illustrated in FIG. 4 and FIG. 5.

When the amount exceeds 1 g/m$^2$, the paint adhesion and the corrosion resistance after paint coating are deteriorated. This is considered to the fact that the mechanically removed surface is covered predominantly by zinc.

In FIG. 4, the vertical axis indicates the blister estimation according to the testing method described in the examples, and in FIG. 5 the vertical axis indicates the Erichsen estimation according to the testing method described in the examples.

When the amount of zinc remaining on the mechanically removed surface is less than 1 g/m$^2$, the surface is composed chiefly of the activated iron surface, and this activated iron surface improves the paint adhesion and the corrosion resistance after the paint coating.

If the amount of the remaining zinc is less than 0.001 g/m$^2$, no substantial improvement of the mechanically removed surface is obtained, but it only increases the cost of the mechanical removal of the coated metal to remove the coated metal until the amount of remaining zinc becomes less than 0.001 g/m$^2$.

Conventionally known a one-side zinc coated steel sheet prepared by masking one side of the steel sheet with water glass and a phosphate solution and hot-dipping this one-side masked steel sheet in a molten zinc bath, and it is also conventionally known to brush the non-coated iron surface as an after-treatment.

The present invention is completely distinct and different from this conventionally known art in that 1 g/m$^2$ to 0.001 g/m$^2$ of zinc is retained on the mechanically removed surface and the zinc remaining in an amount within the above range produces no hinderance to the paintability, but rather improves the paint adhesion better than that of a cold rolled steel sheet.

The term "activated surface" should be understood correctly from the following definition.

The activated surface is a surface which is readily applicable to the phosphate treatment which is done as a pretreatment for the paint coating. In the phosphate treatment, the paintability, particularly paint adhesion, is remarkably improved by the formation of a very dense and homogenous phosphate film. The surface activated by the mechanical removal of the coated metal is considered to be highly sensitized to the electro-chemical reactions such as seen in the chemical conversion treatment of the steel sheet by the residual strain in the surfacial layer (denatured layer by the working) caused by the mechanical removal.

DESCRIPTION OF PREFERRED EMBODIMENTS

The present invention will be better understood from the following description of preferred embodiments in reference to the attached drawings.

Figure 6:
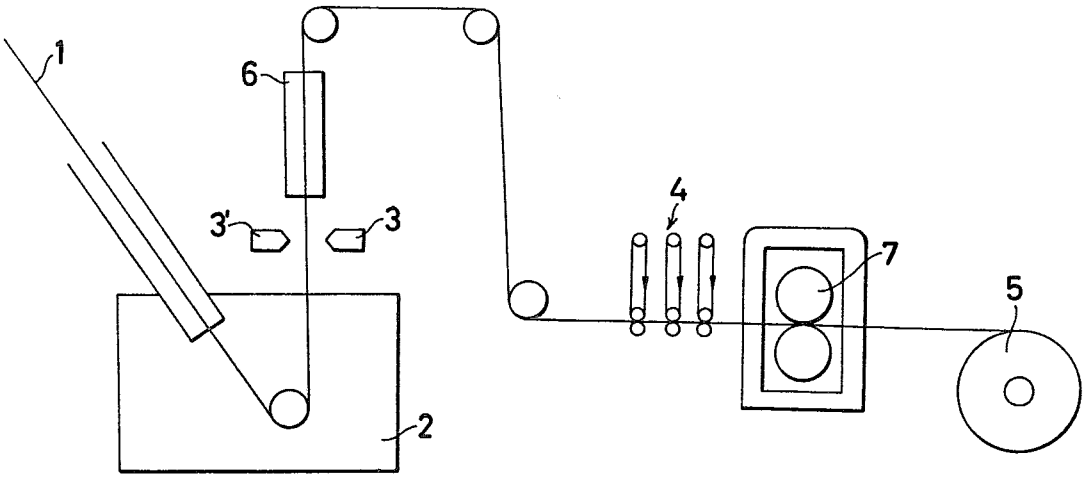
FIG. 6 shows schematically one example of the production method according to the present invention.

In FIG. 6, a steel strip 1 coming out of a pretreatment furnace (not shown) is subjected to surface cleaning, introduced to a zinc-plating bath 2, where both sides of the steel strip 1 are coated with zinc, taken upward from the bath, and blown with the air from a jet nozzle 3 to control the zinc coating amount on one side to a predetermined value, for example 120 g/m$^2$ and simultaneously blown with the air from another jet nozzle 3' to control the zinc coating amount on the other side to a predetermined value, for example, 30 g/m$^2$ (this difference in the coating amount may be attained by increasing the jet pressure of the nozzle 3' larger than that of the nozzle 3, or by arranging the nozzle 3' closer to the strip than the nozzle 3). The strip thus zinc coated is introduced to an alloying furnace 6 where both sides or one side to be subsequently mechanically removed is subjected to the alloying treatment, then introduced to a mechanical removing device 4 (beltsander) where the zinc coated on the one side having the thinner zinc coating is removed, subsequently subjected to a skin pass rolling to adjust the surface maximum roughness, and coiled into coils 5 for shipment.

According to the studies and experiments conducted by the present inventors, the grinding number and speed are expressed by the following formula.

$$Zn(P)=Zn(O)\exp\{-d(V/v)^n\cdot P\}$$

Where

Zn(O) is the amount of Zn (g/m$^2$) prior to the removal

V is the circumferential speed of the belt v is grinding speed

P is number of grindings d, n are respectively a constant determined depending on the operation conditions of the beltsander excepting V, v, P.

Zn(P) is the amount of Zn (g/m$^2$) remaining on the ground surface after the P number of grindings.

By using the above formula, if the necessary grinding number for removing 30 g/m$^2$ of Zn is to be sought for with a belt circumferential speed of 2200 m/minute, the result is shown in FIG. 7. Thus, it is enough to arrange a 3 to 4 high beltsander only for attaining a residual zinc amount of 0.5 g/m$^2$ by a grinding speed of 60 m/min.

It will be noted that the above formula is irrespective to the grit size if the belt grit size is larger than No. 180, and if the belt grit size at the last stage is maintained smaller than No. 180, it is possible to attain a surface maximum roughness of not larger than 10μ Hmax.

EXAMPLE I

This group of examples is to illustrate the alloying of the coated metal and feasibility of the coated metal removal. All of the steel sheets used in this example are prepared by the process shown in FIG. 6.

Table I

| | (1) Sample steels | |
|---|---|---|
| No. | Amount of Coated Metal Prior to Removal (g/m$^2$) | Alloying Degree (Fe %) |
| 1 | 35 | 12.0 |

Table I-continued

| (1) Sample steels | | |
|---|---|---|
| No. | Amount of Coated Metal Prior to Removal ($g/m^2$) | Alloying Degree (Fe %) |
| 2 | 38 | 10.0 |
| 3 | 30 | 19.0 |
| 4 | 30 | 7.0 |
| 5 | 30 | 3.0 |
| 6 | 40 | 1.0 |

The zinc-coated steel strip were prepared by hot-dipping in a Sendzimir-type continuous zinc plating line to coat both sides of the strip, and the zinc coating amount was controlled by a gas wiper above the plating bath to attain 183 $g/m^2$ on one side and various coating amounts on the other side as shown above, and the other side was heated by gas flame to obtain various alloying degree as shown above.

plated steel strips obtained by the above method and the following results were obtained.

| Examples | Estimation |
|---|---|
| II-1 | ◎ |
| II-2 | o |
| II-3 | o |
| Comparison | x |

The estimation standards of the paint coated appearance
◎ There is no appearance of linear surface damage (scratches).
o There is some appearance of the same.
Δ There is considerable appearance of the same.
x There is distinct appearance of the same all across the strip width.

EXAMPLE III

Table II

| (2) Grinding Condition and Residual Zn Amount (2-1) Removal by Beltsander | | | | | | |
|---|---|---|---|---|---|---|
| | | Strip | Grinding Conditions | | | Residual |
| Examples | Samples No. | Speed (m/min) | Speed (m/min) | Pressing Force (kw/in) | Grit No. (Pass No.) | Zn Amount ($mg/m^2$) |
| I-1 | 1 | 60 | 1800 | 1.0 | #120 (2P)<br>#120 (1P) | 200 |
| I-2 | 2 | 50 | 2200 | 1.2 | #120 (2P)<br>#180 (1P) | 120 |
| I-3 | 4 | 40 | 1800 | 0.8 | #120 (1P)<br>#180 (1P) | 230 |
| Comparative | 6 | 40 | 1800 | 1.0 | #120 (1P)<br>#180 (1P) | 5300 |

Remark: The roll rotation is contrary to the strip travelling direction.

Table III

| (2-2) Removal by Brushroll | | | | | | | | | | |
|---|---|---|---|---|---|---|---|---|---|---|
| | | | Grinding Conditions | | | | | | | |
| Examples | Samples No. | Strip Speed (m/min) | Roll dia. (mm) | Bristle Length (mm) | Bristle Line dia. (mm) | Tuft Density (%) | Roll Rotation Speed (times/min) | Pressing Force ($kg/m^2$) | Residual Zn Amount ($mg/m^2$) |
| I-4 | 1 | 40 | 300 | 50 | 0.5 | 50 | 1000 | 4.0 | 280 |
| I-5 | 3 | 40 | 300 | 50 | 0.5 | 50 | 1200 | 4.2 | 320 |
| Comparative | 5 | 40 | 300 | 50 | 0.5 | 50 | 1200 | 4.0 | 8600 |

Roll brush made of stainless steel
The alloyed layer or metal coated on one side was removed by the beltsander or brushroll to obtain one-side zinc-plated steel strip which was coiled. As understood from the results shown in the above, the removal of the coated metal is satisfactory if the coated metal is alloyed, and thus a satisfactory one-side zinc-plated steel sheet is obtained.

EXAMPLE II

This group of examples illustrate the relation between the surface conditions after the paint coating and the temper rolling applied after the mechanical removal of the coated metal.

This group of examples illustrates the paint coated appearance, paint adhesion and corrosion resistance after the paint coating of the mechanically removed surface, when the surface has a surface roughness of not rougher than 10μ and a residual zinc amount ranging Table IV

| | Zn Coating Amount | | Conditions of Beltsander | | | | Travelling Speed of coated strip | Conditions of Temper Rolling | |
|---|---|---|---|---|---|---|---|---|---|
| Example | One side | Removed coating | Speed | Grit No. | Pressing force | Number of Beltsander | | Roll Surface Roughness | Reduction |
| | $g/m^2$ | $g/m^2$ | m/min. | | kw/in | | m/min. | μ-yms | % |
| II-1 | 183 | 150 | 2400 | #180 | 1.5 | 3 | 150 | 2.8 | 1.2 |
| II-2 | 183 | 80 | 1500 | #160 | 1.0 | 3 | 150 | 1.6 | 3.5 |
| II-3 | 183 | 40 | 800 | #150 | 0.8 | 3 | 150 | 2.0 | 5.0 |
| Comparison | 183 | 40 | 800 | #150 | 0.8 | 3 | 150 | — | — |

(1) The coated metal on one side only was removed by the beltsander.
(2) The rotation direction of the beltsander was contrary to the travelling direction of the strip.
(3) In Examples II-1, II-2 and II-3, the coated metal on one side to be removed was subjected to alloying treatment.

The amount of zinc remaining on the mechanically removed surface was less than 1 $g/m^2$ in all of the above examples and the comparison.

Then epoxy resin paint was sprayed in 50μ on the mechanically removed surface of the one-side zinc-from 1 $g/m^2$ to 0.001 $g/m^2$.

Table V

| | Zinc Surface | | Mechanically Removed Surface | | |
|---|---|---|---|---|---|
| | Type | Amount | Amount of Residual Zn | Surface Roughness (Hmax) | Skin Pass |
| Example III-1 | Alloying | 45g/m² | 0.01g/m² | 5 μ | None |
| Example III-2 | Zn | 120 | 0.1 g/m² | 3.5μ | Roll Roughness 2.8μ-γms Reduction 0.6% |
| Example III-3 | Zn | 150 | 0.8 g/m² | 4.5μ | Roll Roughness 1.6μ-γms Reduction 1.0% |
| Comparison | Cold Rolled Steel Sheet | | | | Roll Roughness 2.8μ-γms Reduction 1.2% |

Table VI

| | Mechanically Removed Surface | | | | | | |
|---|---|---|---|---|---|---|---|
| | Paint Coated | Primary Adhesion | | Secondary Adhesion | | Corrosion Resistance | Zn Surface |
| Testing | Appearance | Check Pattern Erichsen | Impact Test | Check Pattern Erichsen | Impact Test | after paint coating | Corrosion Resistance |
| Example III-1 | No scratch-stripe | 100 | 10 | 80 | 10 | 8 | 50 hours |
| Example III-2 | No scratch-stripe | 100 | 10 | 80 | 10 | 8 | 100 hours |
| Example III-3 | No scratch-stripe | 90 | 10 | 80 | 9 | 7 | 120 hours |
| Comparison | No scratch-stripe | 50 | 10 | 40 | 3 | 7 | Immediately corroded |

Testing methods: (see JIS G-3312)

(1) Paint coated appearance

The mechanically removed surface is subjected to a zinc phosphate conversion treatment and coated with 20μ electro-deposited paint, 15μ intermediate paint and 25μ upper paint (total 60μ coating) and the paint coated appearance is observed by naked eyes to detect traces of scratch stripes.

(2) Primary paint adhesion

The mechanically removed surface is subjected to a zinc phosphate conversion treatment, and coated with 20μ polyester electro-deposited paint for testing.

(a) Check pattern Erichsen test

The test piece is scratched in check patterns with 2 mm distance with a knife-edge and extruded in 6 mm by the Erichsen extruder to peel off the paint coating with a cellophane tape, and the adhesion estimation is given in the dimensional percentage of the surface on which the paint coating is not peeled off.

(b) Impact test

Impact is given on the paint coated surface by a Du-Pond impact tester with a punch diameter of ½ inch, a hammer weight of 1 kg, and a dropping height of 30 cm to peel off the paint coating with a cellophane tape.

The estimation is given in ten steps. In case when there is no damage on the paint coating, the full score point of 10 is given, and when the paint coating is completely peeled off, the score point of 1 is given.

(c) Secondary adhesion

The test-piece of (2)* is immersed in water at 38° C. for 144 hours, and then subjected to the check pattern Erichsen test and the impact test.

* The test-piece was pretreated and painted in a similar way as in (2).

(d) Corrosion resistance after the paint coating

The test-piece treated in a similar way as in (2)* is sealed on the back side and subjected to a salt-spray test for 400 hours according to JIS Z-2371 to estimate the blister occurrence on the paint coated surface according to ASTM D-714.

* The test-piece was pretreated and painted in a similar way as in (2).

(e) Corrosion resistance of the zinc coated surface

The mechanically removed surface is sealed, and the bare zinc-coated surface is subjected to a salt-spray test according to JIS Z-2371 to determine the time until red rust appears up to 5% in a dimension proportion.

What is claimed is:

1. A method for producing a steel sheet coated with zinc or a Fe-Zn alloy on one side comprising:
   (a) zinc-plating both sides of the steel sheet;
   (b) heating at least one side of the zinc-plated steel sheet to form a uniformly Fe-Zn alloyed layer having an iron content from 6 to 20% by weight on said one side;
   (c) mechanically removing the Fe-Zn alloy layer on said one side so as to leave an alloy layer on said one side corresponding to 0.001 g/m² to 1 g/m² of Zn; and then
   (d) temper-rolling said one side to flatten it.

2. The method of claim 1 in which the sheet is reduced from about 0.2 to 5.0% during the temper-rolling by means of a roll having a surface roughness ranging from 1.6 to 3.6μ-r.m.s.

3. The method of claim 1 in which the Fe-Zn alloy layer is removed by a belt sander and the amount of the residual Zn is adjusted by the formula $$Zn(P)=Zn(O)\exp\{-d(V/v)^n\cdot p\}$$

wherein

Zn(O) is the amount of Zn (g/m²) prior to the removal,

V is the circumferential speed of the belt, v is the grinding speed,

P is the number of grindings, d, n are, respectively, a constant determined depending on the operation conditions of the belt sander excepting V, v, P, and Zn(P) is the amount of Zn ($g/m^2$) remaining on the ground surface after the P number of grindings.

4. The method of claim 1 in which the Fe-Zn alloy layer is removed by a belt sander with a grit size at the last stage of less than No. 180 to give a surface roughness not larger than 10μ Hmax on said one side.

5. The method of claim 1 in which the temper-rolling is carried out to give a surface roughness not larger than 10μ Hmax to said one side of the steel sheet.

6. The method of claim 1 wherein the heating is carried out at a temperature from 500° to 1000° C. for 5 to 50 seconds.

7. The method of claim 1 wherein the sheet after being temper-rolled has a surface roughness not larger than 10 μHmax and the mechanical removal is carried out to leave an alloy layer on said one side corresponding to 0.001 $g/m^2$ to 1 $g/m^2$ of Zn.

8. The method of claim 1 wherein the heating step is carried out so as to form an alloy layer containing at least one iron-zinc alloy selected from the group consisting of zeta, $delta_1$ and gamma iron-zinc alloys.

9. A method for producing a zinc alloy coated steel sheet comprising:

(a) zinc-plating both sides of the steel sheet;

(b) heating both sides of the zinc-plated steel sheet to form a uniformly Fe-Zn alloyed layer having an iron content from 6 to 20% by weight on both sides; and (c) mechanically removing the Fe-Zn alloy layer from one of said sides so as to retain an alloy layer on said side corresponding to 0.001 $g/m^2$ to 1 $g/m^2$.

10. A method for producing a steel sheet coated with zinc or a Fe-Zn alloy on one side comprising:

(a) zinc-plating both sides of the steel sheet;

(b) heating at least one side of the zinc-plated steel sheet to form a uniformly Fe-Zn alloyed layer having an iron content from 6 to 20% by weight on said one side; and (c) mechanically removing the Fe-Zn alloy layer on said one side so as to retain an alloy layer on said side corresponding to 0.001 $g/m^2$ to 1 $g/m^2$.

* * * * *